US009102494B2

(12) United States Patent
Fenile

(10) Patent No.: US 9,102,494 B2
(45) Date of Patent: Aug. 11, 2015

(54) COLLATING APPARATUS

(75) Inventor: Roberto Fenile, Wetzikon (CH)

(73) Assignee: Ferag Ag, Hinwil (CH)

( * ) Notice: Subject to any disclaimer, the term of this patent is extended or adjusted under 35 U.S.C. 154(b) by 10 days.

(21) Appl. No.: 13/066,958

(22) Filed: Apr. 28, 2011

(65) Prior Publication Data

US 2011/0266116 A1 Nov. 3, 2011

(30) Foreign Application Priority Data

Apr. 30, 2010 (CH) ..... 654/10

(51) Int. Cl.

| | |
|---|---|
| ***B65H 39/00*** | (2006.01) |
| ***B65H 39/02*** | (2006.01) |
| ***B65H 5/08*** | (2006.01) |
| ***B65H 29/00*** | (2006.01) |
| ***B65H 29/04*** | (2006.01) |
| ***B65H 29/60*** | (2006.01) |

(52) U.S. Cl.

CPC ..... *B65H 39/02* (2013.01); *B65H 5/085* (2013.01); *B65H 29/003* (2013.01); *B65H 29/04* (2013.01); *B65H 29/60* (2013.01); *B65H 2301/42244* (2013.01); *B65H 2301/437* (2013.01); *B65H 2301/4322* (2013.01); *B65H 2301/4354* (2013.01); *B65H 2301/4473* (2013.01); *B65H 2301/44712* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,122,362 | A * | 2/1964 | Vollrath et al. | 270/52.19 |
| 3,953,018 | A | 4/1976 | Maopolski | |
| 4,477,067 | A | 10/1984 | Wise | |
| 7,516,839 | B2 * | 4/2009 | Maeder et al. | 198/778 |
| 7,547,008 | B2 * | 6/2009 | Belanger | 270/52.15 |
| 2007/0131593 | A1 * | 6/2007 | Burns et al. | 209/584 |
| 2007/0194519 | A1 * | 8/2007 | Belanger | 271/204 |

FOREIGN PATENT DOCUMENTS

| | | | |
|---|---|---|---|
| DE | 195 00 560 | A1 | 7/1996 |
| DE | 196 42 118 | A1 | 4/1998 |
| EP | 0 389 745 | | 10/1990 |
| EP | 0 765 247 | B1 | 4/1997 |
| EP | 0 806 392 | A2 | 11/1997 |
| EP | 1 302 418 | B1 | 4/2003 |

(Continued)

*Primary Examiner* — Gene Crawford
*Assistant Examiner* — Lester Rushin
(74) *Attorney, Agent, or Firm* — Pauley Petersen & Erickson

(57) ABSTRACT

The invention relates to a collating apparatus (90), which includes a conveying track on which, in a closed circuit, a multiplicity of receiving units (13) arranged one after another in the direction of circulation to hold pre-products to be collated circulate, and on which, in at least one collating region (94, 95, 96), a plurality of feed devices are arranged one after another in the direction of circulation, from which pre-products are discharged into the receiving units (13) moving past on the conveying track. In such a collating apparatus, flexible operation is made possible in that the receiving units (13) are conveyed on the conveying track by means of a three-dimensionally flexible, preferably chain-like, conveying element, in that the receiving units (13) in each case have clamping means, which hold the pre-products collated in the receiving units (13) in a clamped manner, and in that at a plurality of points of the conveying track there are arranged transfer devices (91, 92, 93) which transport collated pre-products away from the receiving units (13) for post processing.

20 Claims, 9 Drawing Sheets

(56) References Cited

FOREIGN PATENT DOCUMENTS

| | | | |
|---|---|---|---|
| EP | 1 321 410 | A1 | 6/2003 |
| EP | 1 935 821 | A1 | 6/2008 |
| GB | 2 089 328 | A | 6/1982 |
| WO | WO 2004/013026 | A1 | 2/2004 |
| WO | WO 2009/015503 | A1 | 2/2009 |

* cited by examiner

COLLATING APPARATUS

BACKGROUND OF THE INVENTION

1. Field of the Invention

The present invention refers to the field of post print press processing, specifically a collating apparatus and method for operating a collating apparatus.

2. Discussion of Related Art

The prior art discloses rigid solutions for collating printed products, which are based on an arrangement of feed stations on a circular or virtually circular conveying track. The document U.S. Pat. No. 3,953,018 discloses a collating apparatus which is based on the object of configuring a machine for inserting newspaper sections into newspaper covers in such a way that it continues to remain in operation even when some assemblies therein fail. This object is achieved in that, on the side of the magazine and downstream of the latter in the direction of migration of the pockets, there is an auxiliary magazine likewise containing covers, the conveyor of which is independent of the conveyor of the magazine and is under the control of a sensor which is assigned to the conveyor of the magazine and responds to the failure of the latter in such a way that, in this case, the conveyor of the auxiliary magazine can be moved in and loads the relevant pocket with the cover. Here, the circular conveying track comprises two identical 180° sectors which, in parallel and in the same way, fill covers with documents and then discharge the latter via two outlets to two conveyor belts. Flexible post processing is not provided.

A similar fault-tolerant collating apparatus having a plurality of outputs and a circular conveying track is also known from EP 0389745. A different type of post processing is not provided in this collating apparatus either. Instead, when one of the plurality of collating lines is interrupted, this collating line is stopped while the other lines continue to operate.

With these known, rigid apparatuses, the problem primarily solved is to continue to process large quantities of printed products, such as arise from the printing press—in particular from the rotary system—in real time.

SUMMARY OF THE INVENTION

In modern print post print press processing, however, in addition to high performance the primary demand is for flexible operation, in which, at different times, different products have to be processed further in different ways. Until now, for each type of post processing, in each case a dedicated collating apparatus has been used, in which pre-products or supplements were collated and in each case fed to one type of post processing, specifically either on a single path or on a number of parallel paths, as the documents cited at the beginning show.

If, in a company, a plurality of post processing processes are intended to be carried out on differently constructed lines with different steps or operations, a corresponding number of collating apparatuses had to be set up and operated. This meant a great deal of expenditure on apparatus and resulted in an increased demand for space.

The object of the invention is therefore to devise a collating apparatus and a method for operating a collating apparatus which avoid the disadvantages of known collating apparatuses and permit flexible operation with reduced expenditure on apparatus and a reduced demand for space.

The objects are achieved by a collating apparatus and method for operating a collating apparatus having the features claimed and/or described. The invention preferably includes receiving units that are conveyed on a conveying track by means of a three-dimensionally flexible, preferably chain-like, intrinsically closed conveying element, in that the receiving units in each case have clamping means which hold the pre-products collated in the receiving units, which means at least one pre-product, in a clamped manner, and in that at a number of points of the conveying track there are arranged transfer devices which pick up collated pre-products or supplements from the receiving units and transport them away for post processing. As a result of the specific configuration of the conveying track, of the receiving units and of the plurality of transfer devices, it is possible to carry out different post processing processes with the collated pre-products one after another or even at the same time as one another while using the same collating apparatus, without any conversion time.

The transfer units according to the invention are units which transfer the products or, in particular, the collated product collections to post processing in a known way from the receiving units of the collating apparatus, in a controlled manner and as far as possible with exact maintenance of the relative position of the products in relation to one another in the collated stack. These units are therefore not to be confused with a rejects removal system, as is also known from generically identical systems of the "Flystream" type from the applicant. Here, only incomplete or excess product collections are discarded or removed in another way and preferably collected in a collecting container. The reject copies must be disposed of or separated out by hand and fed manually to the processing system again. In the apparatuses according to the invention, the rejects removal is carried out in the simplest case by opening the clamps and emptying the receiving units under the force of gravity.

One embodiment of the invention is characterized in that the conveying track comprises an upper track portion or run and a lower track portion or run, which run substantially in parallel and are connected to each other at the ends by deflection regions and form a closed circuit, and in that at least one collating region is provided on the upper track portion and a plurality of transfer devices are arranged on the lower track portion and/or in the deflection regions. The collating regions are distinguished by the fact that pre-products and/or supplements are conveyed to the receiving units by means of at least one feed device in the said regions. Preferably, a plurality of feed devices are arranged in a, space-saving manner on both sides of the conveying track in each collating region.

In particular, the upper track portion and the lower track portion can in each case comprise a plurality of straight track portions, the orientation of which is different and which are connected to one another by at least one curved section.

According to the present invention, pre-products are preferably collated one after another and one above another.

A further refinement of the invention is characterized in that a plurality of collating regions are arranged one after another on the conveying track in the direction of circulation. Since the receiving units are conveyed by means of a three-dimensionally flexible, preferably chain-like, conveying element, a linear section of a conveying track can be rotated about its longitudinal axis, so that the receiving units are conveyed linearly and simultaneously pivoted radially as they run through this section. Without a collating apparatus having an upper run and a lower run, the receiving units can be populated with pre-products or supplements from above in a collating region. The collated product groups can then be discharged downwards by means of pivoting the receiving units through 180° and, by means of renewed pivoting through 180° again, it is possible for products to be guided from above once more in a further collating region. The functionality of the upper run and of the lower run is realized by the pivoting in a region of the apparatus which is aligned substantially linearly.

In particular, at least one transfer device can be provided between successive collating regions.

Furthermore, it is possible for the conveying track to be led out between successive collating regions, forming an intermediate loop, and for the associated transfer device to be arranged on the intermediate loop.

According to another refinement, a plurality of transfer devices are arranged immediately one after another on the conveying track in the direction of circulation without any collating region being located between them.

A further refinement is distinguished by the fact that the conveying track runs predominantly in a horizontal plane.

Another refinement of the invention is characterized in that the feed devices in the at least one collating region are arranged alternately on opposite sides of the conveying track.

A further refinement of the invention is characterized in that a control system is provided which, in a predetermined way, controls the feed devices and the transfer devices such that in each case the desired collections of products are available on the transfer devices.

As already mentioned, with the aid of the new apparatus and the new method, it is made possible, by using the same collating apparatus and without any additional expenditure, to carry out different post processing processes with the collated pre-products without any expenditure on conversion time or even at the same time as one another. Each of the receiving units can be populated with a collection of pre-products and/or supplements in a known way in the collating region. Here, this can be an identical collection in each receiving unit or different receiving units are supplied with products from different feed devices, so that they transport different collections. Depending on the production plan and depending on the capacity of the following processing apparatuses, receiving units following one another directly can be populated with different product collections, or in each case groups of a few to several dozen receiving units are supplied with a specific product collection in batch mode, and a following group is given another collection of products from other feed devices. The fact that the apparatuses according to the invention comprise at least two transfer devices makes it possible to allocate the product collection from each receiving unit to a quite specific transfer device and therefore to feed it to specific post processing.

Thus, for example, identical product collections can be fed via a first transfer device to post processing in which they are inserted into a main product and, via a second transfer device, they can be fed to post processing in which they are sealed in film. The separation of the product streams can optionally be carried out at the same time or one after another for individual receiving units or groups of receiving units.

If different product collections are collated in different receiving units, then a first collection type can be fed via a first transfer device to specific post processing, and a second collection can be fed via a second transfer device to other post processing. This can again be carried out successively, which means that firstly the first collection type is collated and further processed and then the second collection type is collated and further processed. According to the present invention, however, it is now also possible to collate the two types at the same time and to feed them to the envisaged post processing. If the systems needed for the simultaneous post processing are not available or do not have sufficient capacity, a specific collection from a transfer device can also be fed to a storage device, as are known for example from the prior art in the form of large coils or discs, and can be fed to the post or further processing at a later time.

If there are more than two transfer devices in an apparatus according to the invention, then accordingly three and more different types of product collections can be fed to different post processing systems or identical types of product collections are fed to different post processing systems or identical types of product collections are fed to parallel, identical post processing systems.

The apparatuses according to the invention all permit incomplete collections to be fed back and completed. This is made possible by product tracking over the entire apparatus. The control system registers for each receiving unit the type and number of products which are collated therein. Since the position of each receiving unit is known accurately at any time, not only is it possible to repair incomplete product collections with the missing pre-product or pre-products but it is also possible for product collections from specific receiving units to be fed specifically to specific transfer devices.

BRIEF DESCRIPTION OF THE DRAWINGS

The invention is to be explained in more detail below by using exemplary embodiments in conjunction with the drawing, in which.

DESCRIPTION OF PREFERRED EMBODIMENTS

Figure 1:
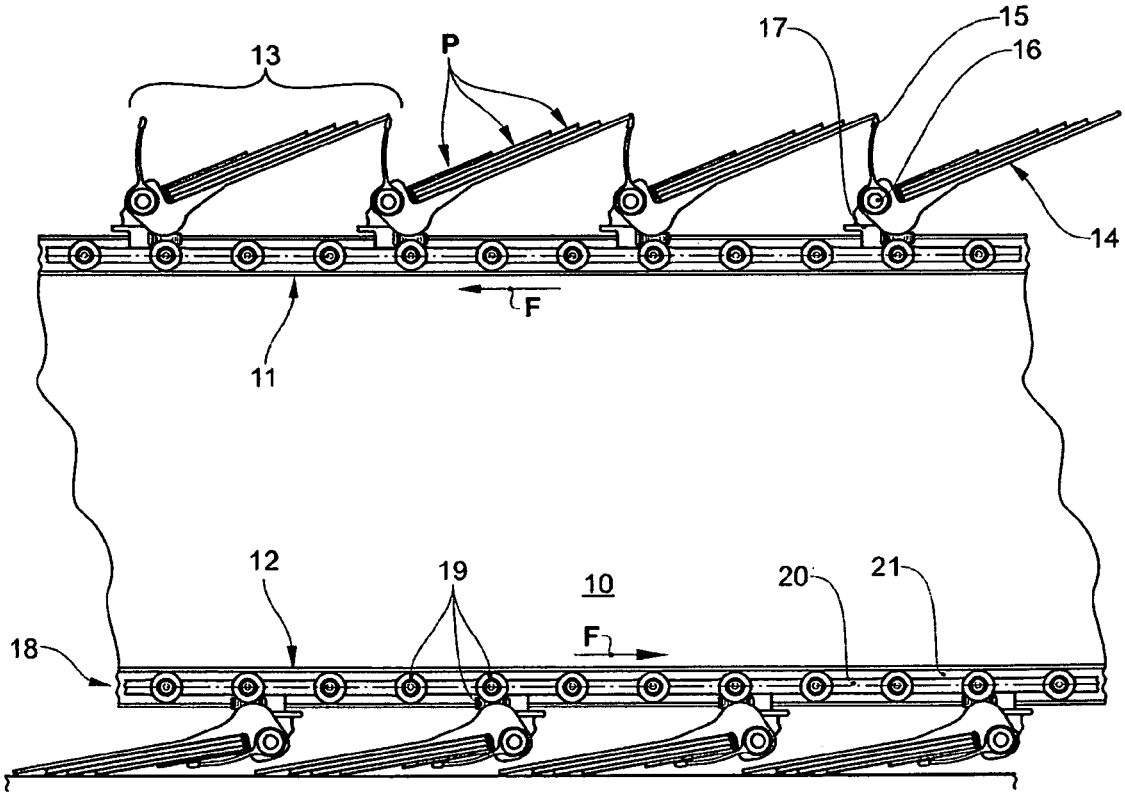
FIG. 1 shows an enlarged detail in a side view of the upper and lower track of a collating apparatus equipped with clamping receiving units, as is particularly suitable to implement the invention.
Figure 2:
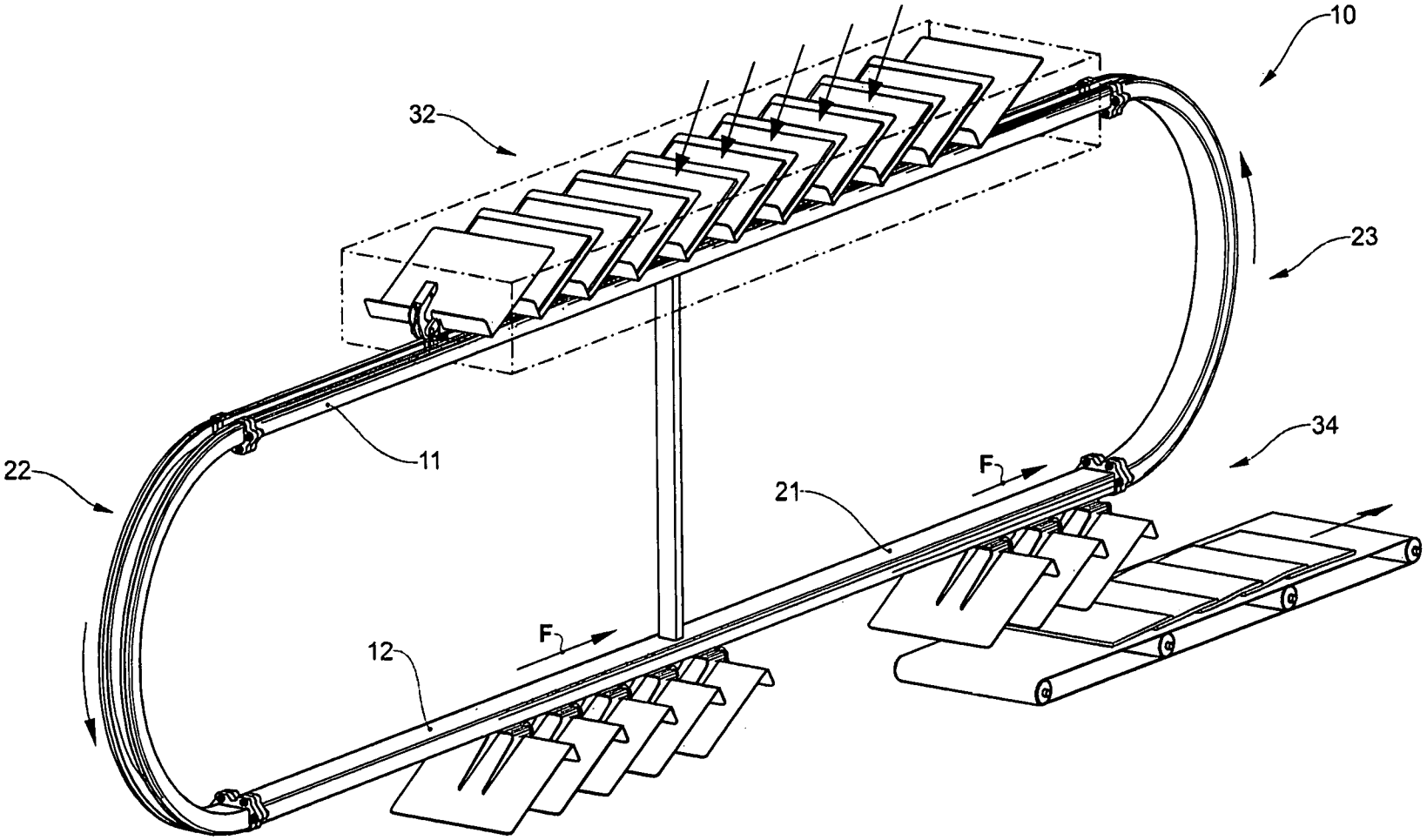
FIG. 2 shows a side view of the configuration of the collating apparatus from FIG. 1, at one point on the circulating conveying track an example of a transfer device for the removal of the collated products being illustrated and the at least one further transfer device having been left out.

FIG. 1 shows in side view a detail of an upper track portion 11 and a lower track portion 12 of a very simple collating apparatus 10, the complete configuration of which is shown in FIG. 2. The track portions 11 and 12 are sections of a closed conveying track which, according to FIG. 2, has a deflection region 22, 23 in each case on opposite sides. According to FIG. 1, a multiplicity of receiving units 13 arranged one after another in the running direction run on the conveying track 11, 12, 22, 23. Each receiving unit 13 comprises a supporting surface 14 standing at an angle, on the lower side of which there is arranged a gripper jaw 15 that can be pivoted about a pivot axis 16. When opened, the gripper jaw 15 is virtually upright on the conveying track, as can be seen in FIG. 1 on the upper track portion 11.

When the receiving unit 13 is open, in a collating region (32 in FIG. 2; see the little box shown dash-dotted) provided for this purpose, products, for example periodicals, newspapers, parts of newspapers, partial and pre-products, supplements, cards, CDs or the like (called pre-products P below) can be fed (led in, inserted or slipped in) one after another into the receiving unit 13, forming a stack, as indicated in FIG. 2. If the stack of pre-products P (also called a collection below) is complete in the receiving unit 13 after running through the collating region 32, the gripper jaw 15 is pivoted into the closed position and therefore the stack of pre-products P is held in a clamped manner in the receiving unit 13. The closed gripper jaws 15 of the receiving units 13 with the collections of pre-products located therein are then transported on the lower track portion 12 to a removal point, where a second transfer device 34 is arranged. The first transfer device is located on the lower run 12 close to the deflection region 22 and is not illustrated in FIG. 2 for reasons of clarity. In the example according to FIG. 2, the transfer device 34 comprises a transport device, illustrated in simplified form as a transport belt, which picks up the stacks or collections of pre-products from the receiving units 13, which are opened again there, and transports the said stacks or collections of pre-products for post processing in apparatuses likewise not illustrated.

For reasons of simplicity, in FIG. 2 and also in FIGS. 5, 8, 9 and 10, in each case only some of the receiving units 13 circulating in the collating apparatus are shown. The receiving units in the apparatuses according to the invention preferably form a sequence circulating without any gaps, the individual receiving units being spaced apart uniformly from one another.

From the example of FIGS. 1 and 2, it can be seen that the receiving units 13 are in each case fixed via a carrier 17 to a chain-like conveying element 18, which comprises a multiplicity of running rollers 19, which are connected to one another via connecting pieces 20 located between them and run in corresponding guide rails 21. The structure of the collating apparatus 10 shown in FIGS. 1 and 2 with the chain-like conveying element 18 has the advantage that the conveying element 18 can be guided and laid very flexibly in space by using curved and/or rotating sections or entire loops, so that the conveying track is able to join to one another various types of production and/or processing units arranged distributed in space.

Figure 3:
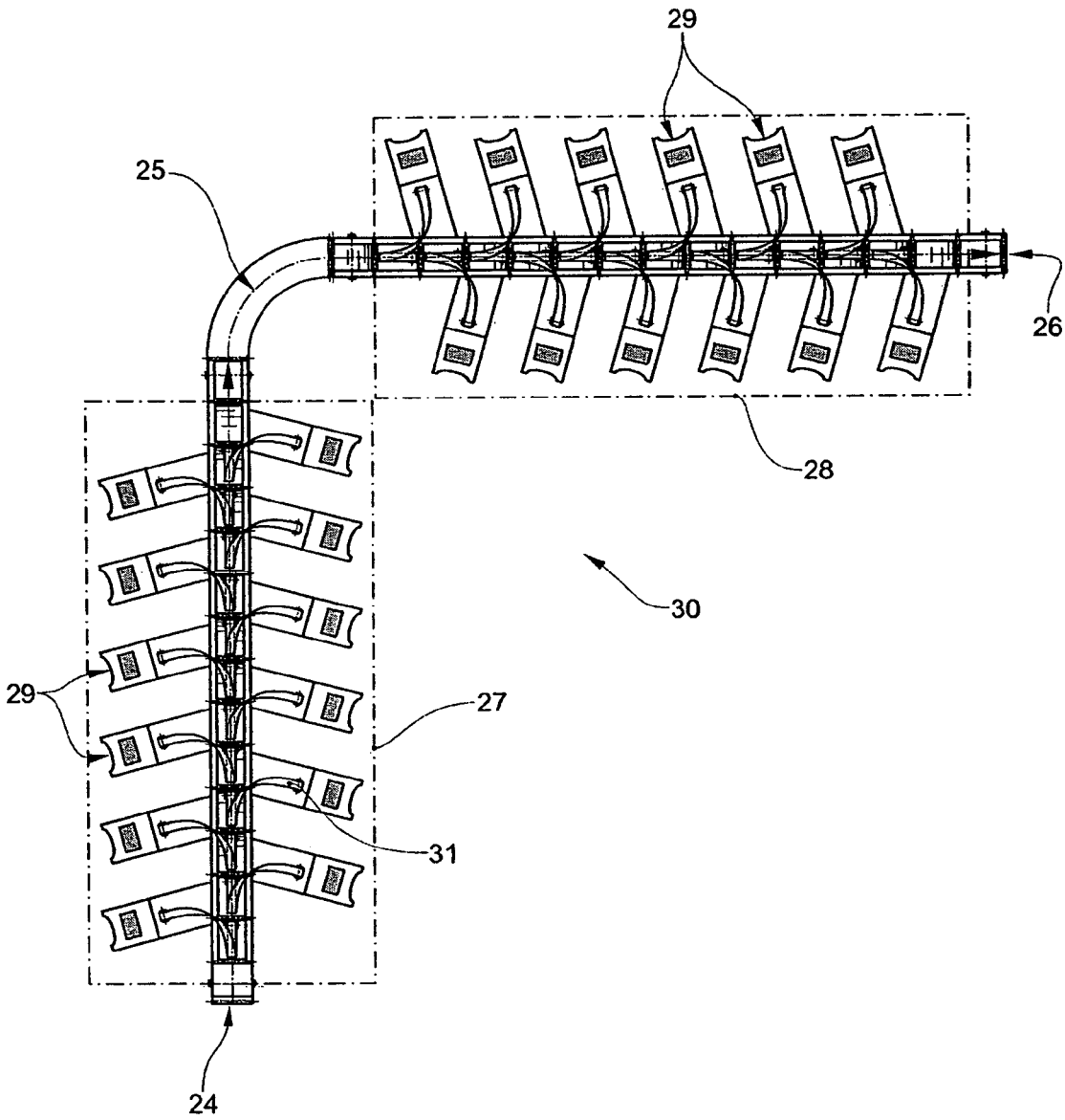
FIG. 3 shows a plan view from above of an example of a collating apparatus according to a further embodiment having two collating regions oriented in different directions, in which feed devices for the pre-products and/or supplements are arranged alternately on opposite sides in each case.

Thus, FIG. 3 shows a plan view from above of an example of a collating apparatus 30 which comprises two track portions 24 and 26 arranged at right angles to each other, to which in each case a dedicated collating region 27 and 28, respectively, is assigned. The two track portions 24, 26 are connected to each other by a curved section 25. In each of the two collating regions 27, 28, in each case alternating on opposite sides of the track, there are arranged feed devices 29 which, for example, pull pre-products off a supply stack and feed them via a spiral track 31 (looping section) into the receiving units moved past. Feeding devices 29 of this type are known under the designation "JetFeeder" from the applicant.

In print post processing, the stacks or collections of pre-products P formed by collating apparatuses 10, 30 according to FIGS. 1-3 are processed further in different ways. In one case, the stacks or collections can, for example, be slipped into open newspapers as supplements. The stacks are then fed to appropriate insertion apparatuses. In another case, the stacks can be welded individually into transparent films in the following unit (what is known as "film wrapping").

Until now, it was usual to employ an individual collating apparatus for each of these different post processing processes. This not only required considerable additional expenditure on the machinery but also took up a considerable amount of space in the production facilities. According to the present invention, a collating apparatus is now used jointly for a plurality of post processing processes, in that a plurality of transfer devices with corresponding transfer devices for the collated pre-products are provided on the conveying track. Each transfer device is then assigned a specific post processing process and the collated pre-products are removed at this outlet when this type of post processing is to be performed. If the type of post processing changes, another outlet is accordingly used. In this way, maximum flexibility in post processing can be achieved with a minimum expenditure on machinery.

Figure 4:
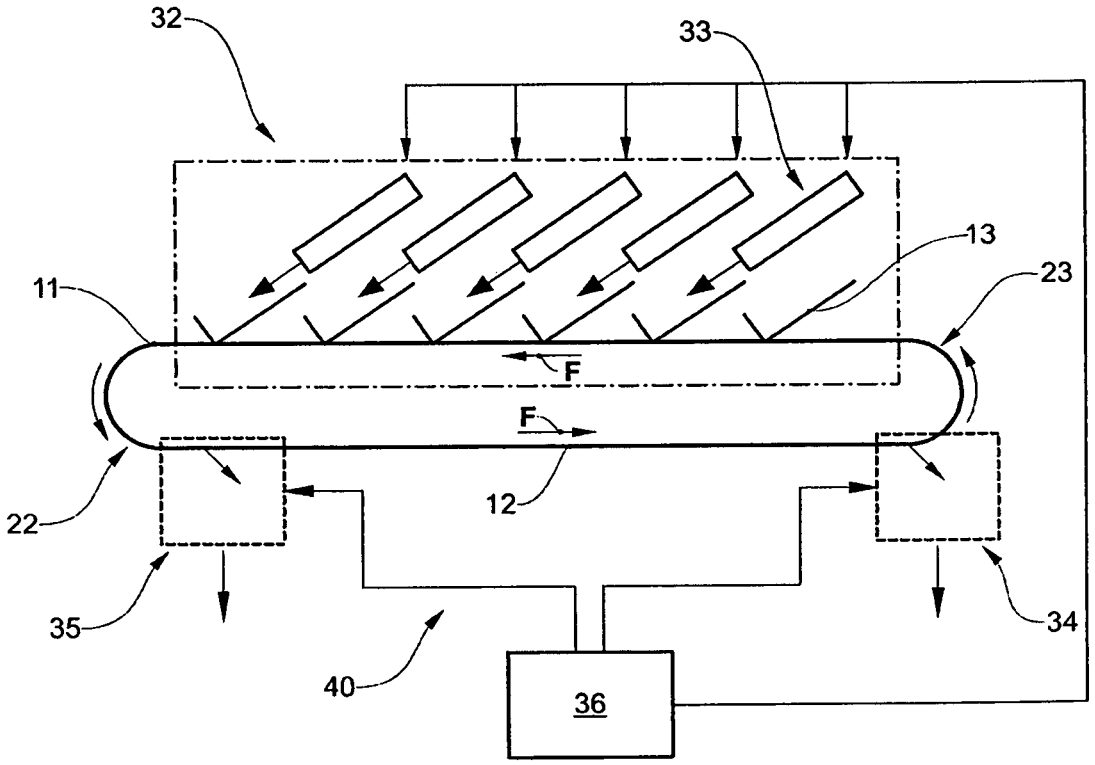
FIG. 4 shows a simplified illustration of a collating apparatus comparable with FIG. 2 in which, according to one exemplary embodiment of the invention, in each case a transfer device is arranged at two different points on the conveying track and a control system is indicated.

FIG. 4 illustrates, in a highly simplified representation, a first exemplary embodiment of a collating apparatus according to the invention. The configuration of the collating apparatus 40 of FIG. 4 largely corresponds to the collating apparatus 10 from FIG. 2, with the difference that, in, addition to the transfer device 34, a further transfer device 35 is arranged on the conveying track 11, 12, 22, 23. The two transfer devices 34, 35 can be actuated individually via a common control system 36. Likewise, the feed devices 33 in the collating region 32 can be actuated individually. If specific collections of pre-products P are to be removed at the transfer device 35 and fed to the type of post processing assigned to this transfer device, corresponding feed devices 33 in the collating region 32 which convey the pre-products envisaged for this purpose are actuated. If, on the other hand, other collections of pre-products P are to be removed at the transfer device 34 and fed to the type of post processing assigned to this transfer device, other feed devices 33 are actuated. Both in FIG. 4 and in the following FIGS. 6 and 7, the transfer devices 34, 35 are reproduced only as rectangles drawn with broken lines, without going further into their structure and function.

On account of the closed circulating guide track, it is possible in every case to implement what is known as a "repair" function. In such a function, a stack of pre-products which has been detected as incomplete is not discharged but led past the feed devices in the collating region once more, where it is completed by actuating the respective feed devices.

The two transfer devices 34 and 35 do not necessarily have to be arranged at opposite ends of the conveying track 11, 12, 22, 23, as shown in FIG. 4. Instead, it is readily possible to arrange both transfer devices 34, 35 shortly after each other on the same side of the conveying track, as illustrated schematically in FIG. 5.

Figure 8:
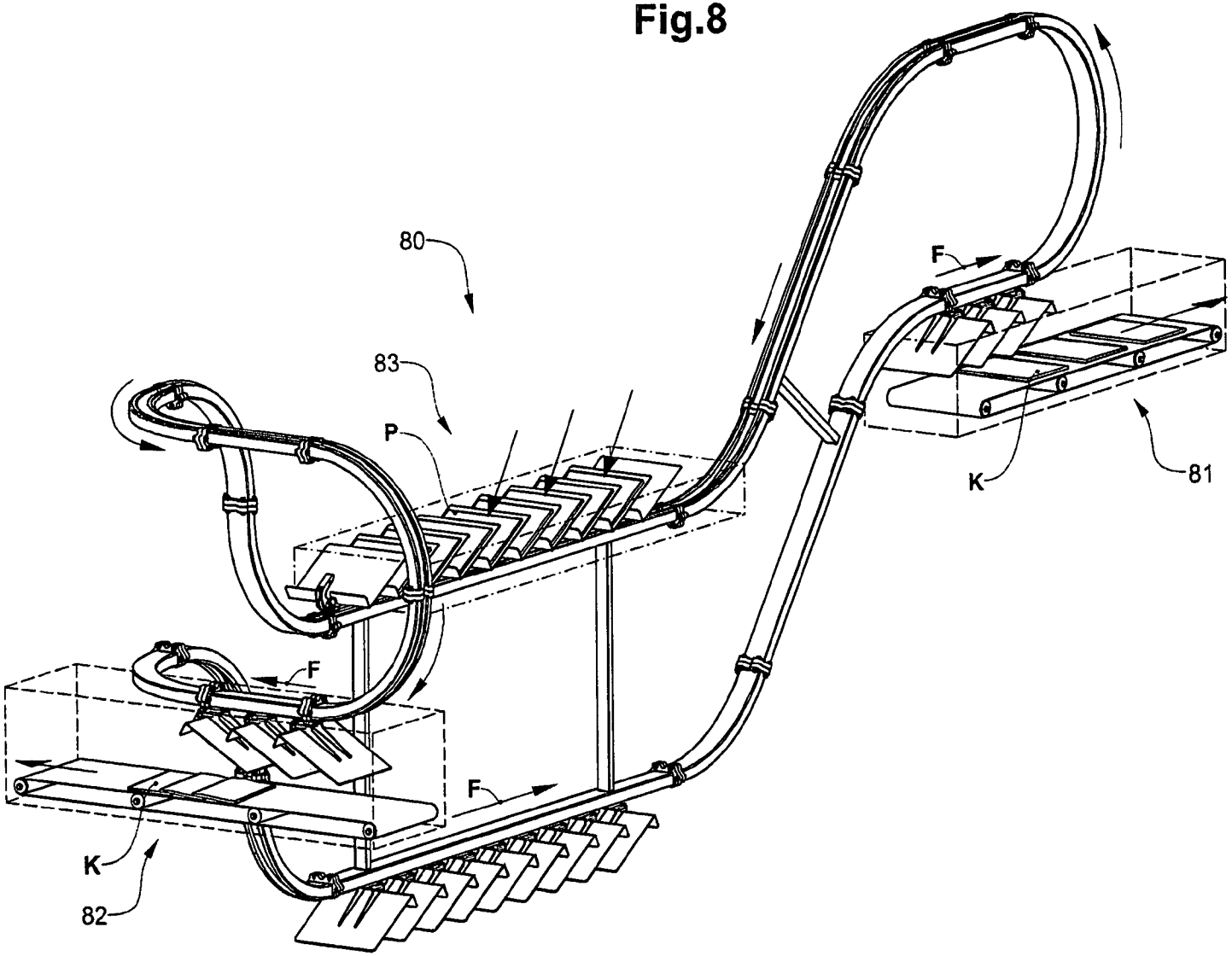
FIG. 8 shows a perspective view of a further exemplary embodiment according to the present invention, in which the conveying track runs in a plurality of horizontal planes and two transfer devices are arranged in different planes and different directions.
Figure 9:
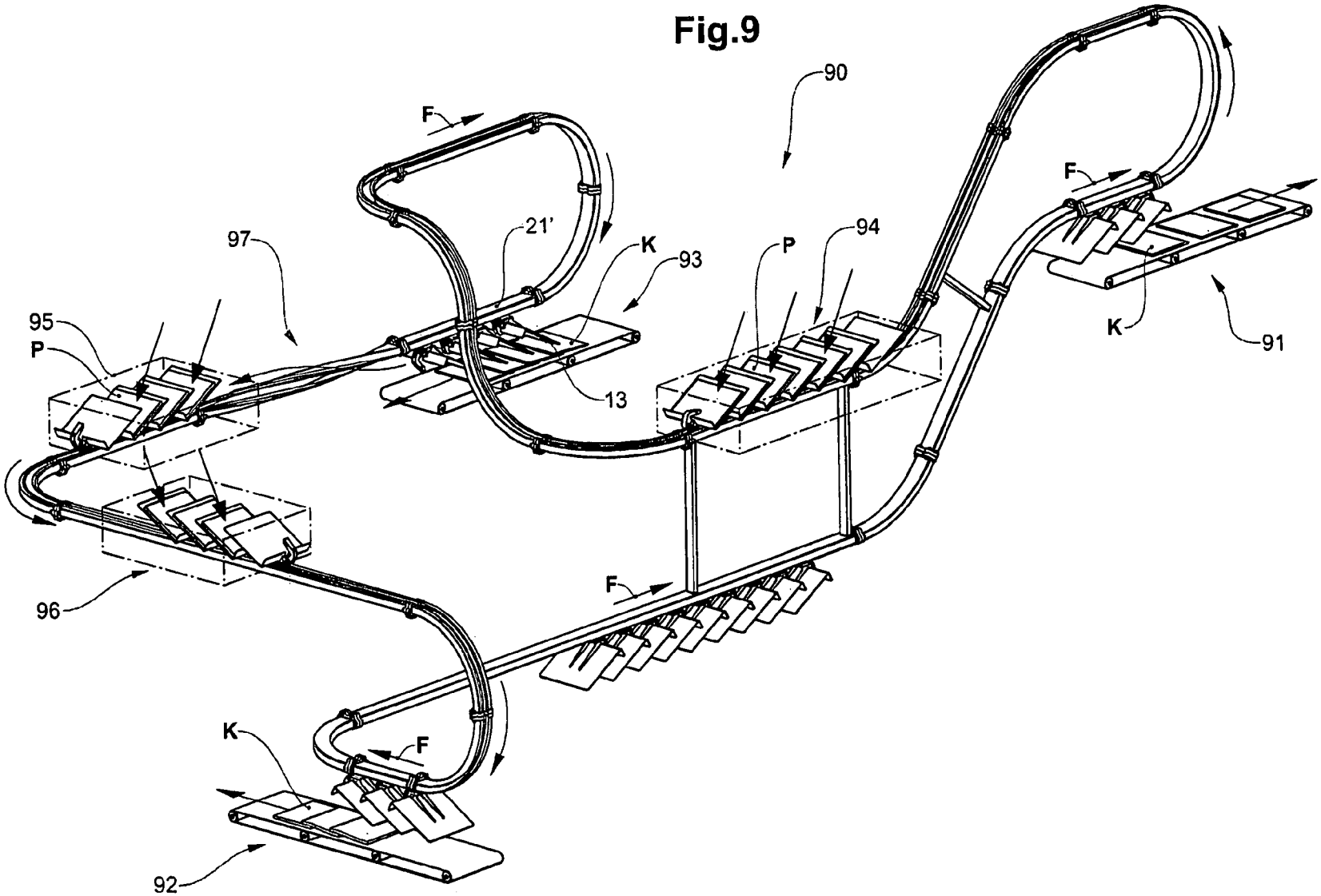
FIG. 9 shows, likewise in a perspective illustration, a further exemplary embodiment, in which three collating regions and three transfer devices are provided.
Figure 10:
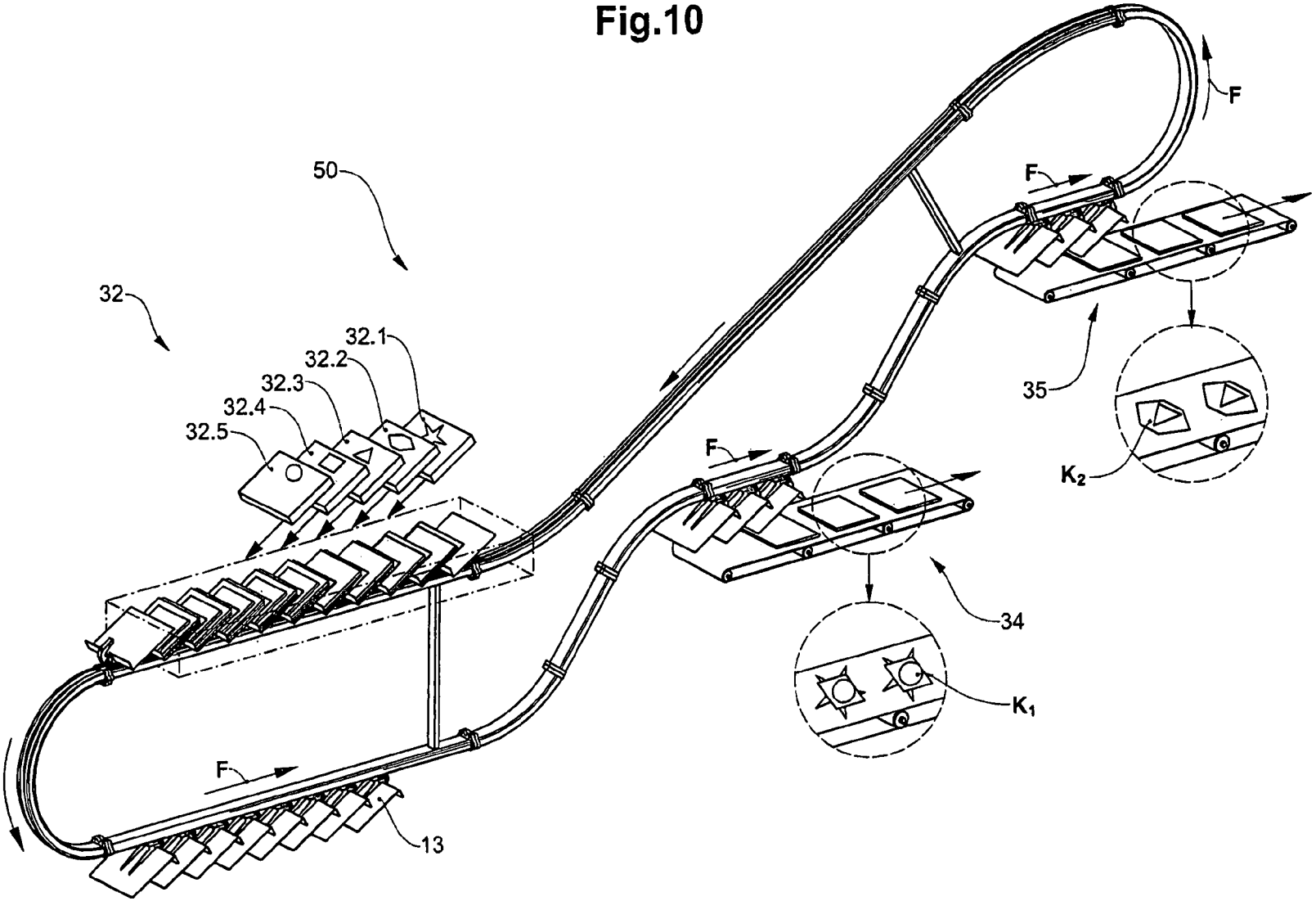
FIG. 10 shows a schematic view of the collating apparatus according to FIG. 5, in which, in the collating region, five feed devices having five different supplements and two transfer devices for discharging a different product collection in each case are sketched.

Both in FIG. 4 and also in FIGS. 8, 9 and 10, the transfer devices 34, 35 are reproduced only in simplified form as small transport-belt boxes, without going into their structure and function in detail. Each of the transfer devices 34, 35 can have the configuration shown in FIG. 2. However, it is also conceivable to employ other types of transfer devices which are able to remove collections of pre-products from the receiving units 13 and feed them to post processing. In particular, it is not absolutely necessary for the stacks of pre-products to be removed in the region of a lower track portion 12, more precisely in regions in which the receiving units are oriented downwards. For example, it is conceivable to open the clamping means of the receiving units 13 on the upper track portion 11, more precisely on a section of the conveying track on which the receiving units are oriented upwards, in order then to remove the formed stack under control by means of a gripping apparatus.

Of course, the number of outlets in a collating apparatus of the type described is not limited to two. If the spatial conditions permit it and the production sequence requires it, according to FIG. 6, more than two transfer devices and outlets can be provided. In the exemplary embodiment of FIG. 6, a total of four transfer devices 34, 35, 37, 38 are employed on the conveying track 39 of the collating apparatus 60 and are placed at different points. While the arrangement of the transfer devices 34, 35 and 37 is already known from FIGS. 4 and 5, special significance is ascribed to the placing of the fourth transfer device 38. The part of the conveying track 39 led through this transfer device 38 is led to the outside in the form of a loop between two successive collating regions 42, 43, so that product stacks which only need the collating region 43 for the collation can be removed immediately without having to pass through the second collating region 42. In this way, the flexibility of operation can be increased further. Of course, for the collation of the product stacks which are transferred to the transfer devices 37, 34 and 35, both collating regions 42 and 43 are used. Here, too, there is a control system (not shown) to implement the various variants of the operation.

Figure 6:
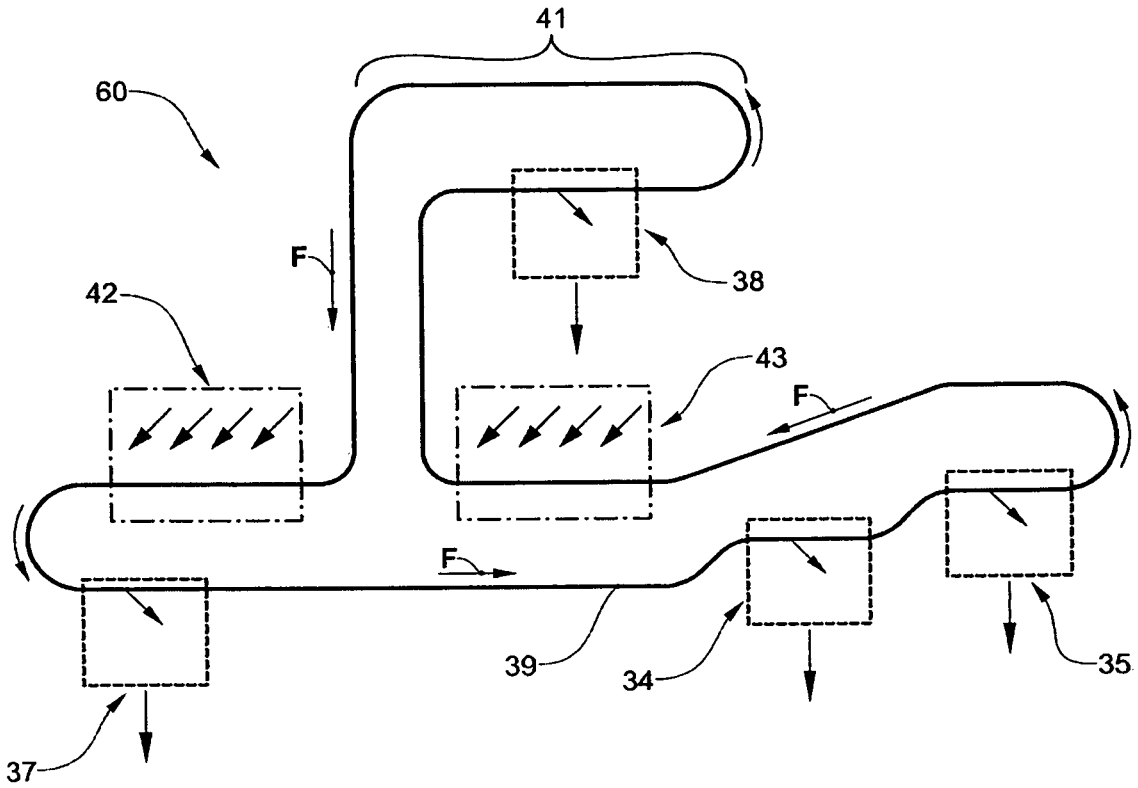
FIG. 6 shows, in an illustration comparable with FIGS. 4 and 5, a further exemplary embodiment of the invention, in which more than two transfer devices are provided at different points on the conveying track, one of the transfer devices being arranged between two successive collating regions.
Figure 7:
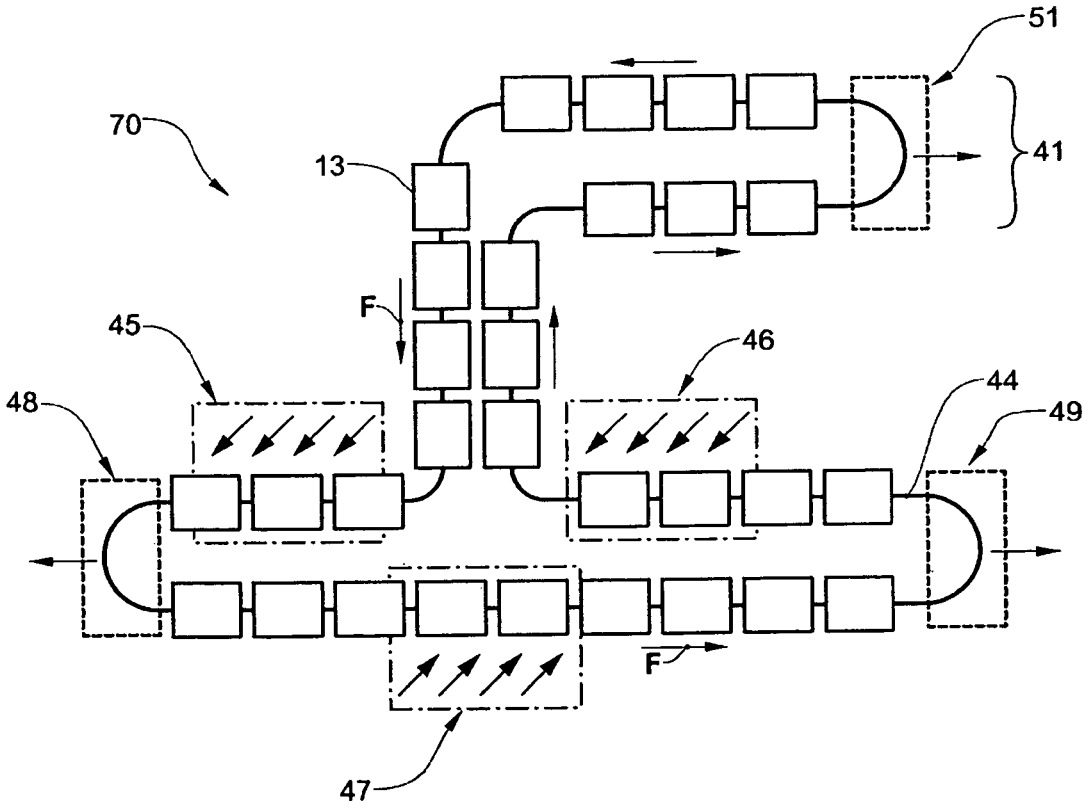
FIG. 7 shows a plan view from above of another exemplary embodiment of the invention, in which the conveying track runs predominantly in a horizontal plane and a plurality of collating regions and transfer devices are provided.

FIGS. 4 and 6 show exemplary embodiments of the invention in side view. Here, the removal of the product stacks is carried out in each case in the region of a lower track portion. This vertical orientation of the track plane is not imperative. Instead, the conveying track can run largely in a horizontal plane, from which—if necessary—it is led down once in a loop in order then to be able to discharge product stacks downwards to a transfer device. Such a horizontal configuration of the conveying track is given in the collating apparatus 70 of FIG. 7. Here, the conveying track 44 of the collating apparatus 70 is seen from above in plan view. This is made clear by the receiving units 13 shown, which are arranged along the conveying track 44 one after another virtually without any gaps or even overlapping (in FIG. 7, for reasons of improved clarity, the receiving units 13 have been left out in bending regions of the conveying track 44). On the conveying track 44, collating regions 45, 46, 47 are provided at various points, in which pre-products are conveyed onto the receiving units 13 led forward. Likewise, at various points on the conveying track 44 there are arranged transfer devices 48, 49, 51, which convey product stacks removed from the receiving units 13 onward to different post processing processes.

In the exemplary embodiment of the present invention shown in FIG. 8, the collating apparatus 80 comprises a central collating region 83 and two transfer devices 81, 82 arranged before and after the collating region 83 in the direction of circulation of the conveying element. It becomes clear from FIG. 8 that the two transfer devices 81, 82 are arranged in different spatial directions.

The collating apparatus 90 which is illustrated in the exemplary embodiment according to FIG. 9 exhibits a still higher level of flexibility. It comprises three collating regions 94, 95, 96 arranged at a distance from one another, of which two are arranged parallel to each other and one at right angles thereto in a plane. The three transfer devices 91, 92, 93 all lie in different planes and discharge the products in various directions. Between the transfer device 93 and the collating region 95, the exemplary embodiment according to FIG. 9 has a pivoting region 97, in which The guide rail 21' is rotated intrinsically spirally through 180° along a straight line. The receiving units 13 which are oriented downwards in the region of the transfer device 93 in order to be able to discharge the product collections downwards under the force of gravity are pivoted through 180° as they pass through the pivoting region 97. The receiving units pass through the subsequent collating region 95 oriented upwards, so that pre-products can be fed in simply from above.

The exemplary embodiments described above make clear what a high level of physical and functional flexibility can be achieved by the apparatus according to the invention.

The conveying directions F, more precisely the corresponding conveying means in the transfer devices according to the invention, which means for example the conveying direction F of the receiving units and the arrangement of a conveyor belt, are preferably arranged in parallel or tangentially with respect to one another in the region of the product transfer. As a result, the product transfer generally and, in particular, the maintenance of the accurate physical alignment of the individual products and of the products in the stack and their controlled discharge is made easier.

By means of the transfer devices according to the invention, the products or product stacks K, as sketched in FIG. 9, can be discharged in an overlapping stream (in the transfer device 92) but also separately (in the transfer device 91) and fed to post processing. As a result of the use of two or more transfer devices, product collections which could be discharged only in an overlapping stream in conventional systems having only one outlet, can be separated and fed to post processing. If two transfer devices are used, the separation can be carried out by a collection being discharged from a first receiving unit in a first transfer device but the collection from the next receiving unit being conveyed through the first transfer device and onward to a second transfer device and discharged only there. In this way, from an overlapping product stream in successive receiving units, two product streams with separated products or collections spaced apart from one another in the conveying direction can be formed, such as are needed for example for a following processing step, for example film wrapping.

The apparatus according to the invention and the method according to the invention permit gaps to be generated specifically in each case in the product streams comprising product collections from the individual transfer devices, irrespective of whether the said streams are fed to post processing separately or in an overlapping stream. Such gaps can be desired for production engineering reasons, for example in order to relieve the load on a subsequent operation/apparatus in the post processing. Such a gap in a product stream may be generated, for example, by two types of collections A and B being collated as follows in successive receiving units in a collating region: A, B, A, B, B, B, A, B, A, B. The fact that the fifth receiving unit is not populated with a collection of type A but with a collection of type B means that no collection is discharged from the fifth receiving unit as it passes the transfer device for the discharge of collections of type A, and a product gap (A, A, _, A, A; called a gap below) is generated in the product stream discharged. The same gap can be generated by the corresponding feed devices not discharging the pre-products for the fifth receiving unit (A, B, A, B, _, B, A, B, A, B), so that once more a gap is formed at the third point in the discharged product stream of the collections of type A.

Figure 5:
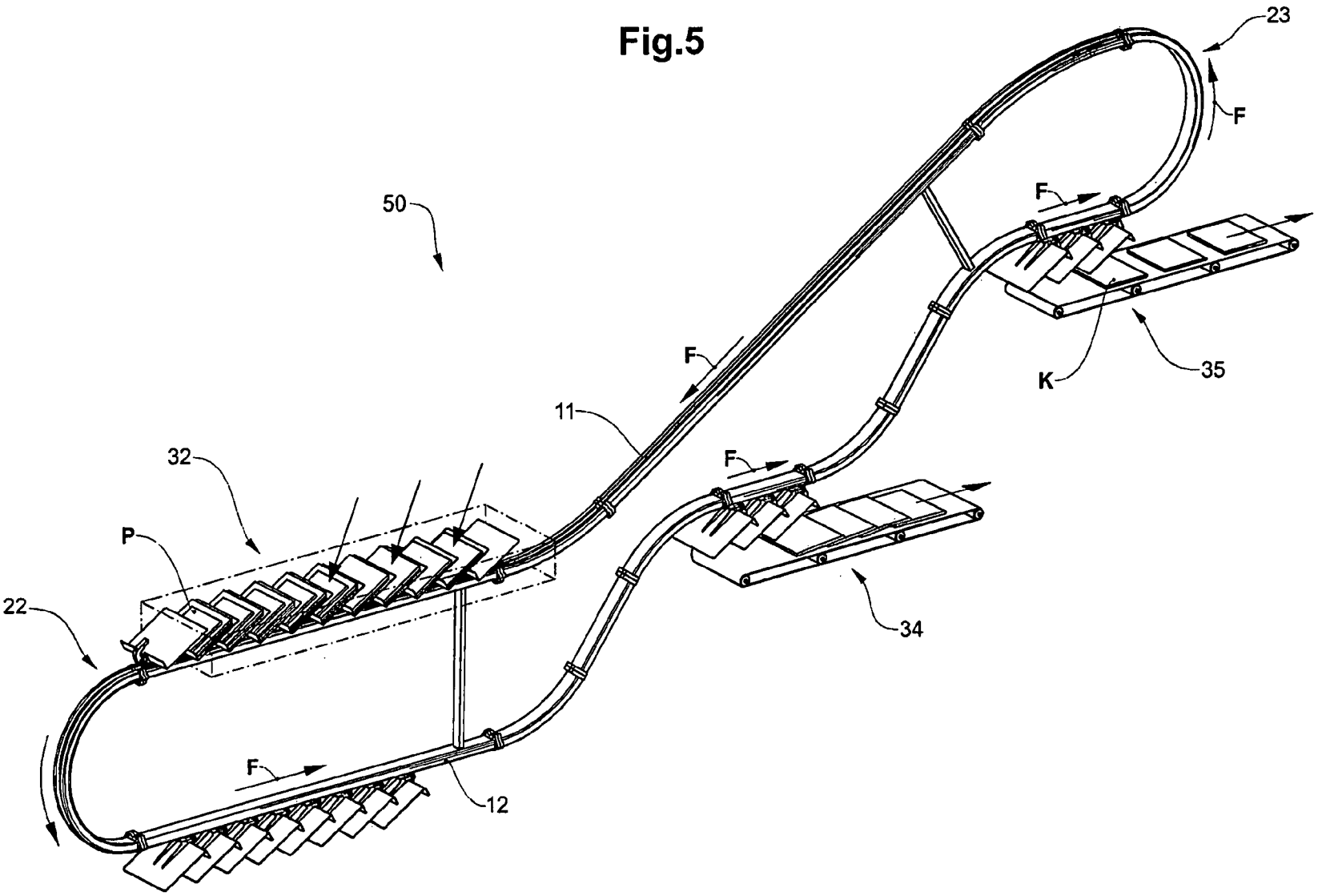
FIG. 5 shows, in an illustration comparable with FIG. 4, a further exemplary embodiment of the invention, in which two separate transfer devices are arranged at one end of the conveying track.

In FIG. 10, by using an exemplary embodiment as is already illustrated in FIG. 5, it is intended further to indicate the high degree of flexibility that is made possible during the operation of the apparatuses according to the invention. The collating apparatus 50 shown has a collating region 32 in which five different supplements or pre-products (indicated in the figure by five different graphic symbols) can be discharged to the receiving units by five feed devices 32.1-32.5. In the operating mode illustrated, two different types of product collections K1, K2 are produced. The first collection type K1 comprises three supplements which originate from the feed devices 32.1, 32.4 and 32.5. The second type produced comprises products from the feed devices 32.2 and 32.3. According to a preferred embodiment, collections of the first and of the second type are collated alternately in the receiving units 13. While a first receiving unit discharges the product collection K1 in the transfer device 34 for conveyance onward and post processing, the clamp of a following receiving unit, which conveys a product collection K2, remains closed as it passes through the transfer devices 34 and is opened only after the transfer device 35 has been reached. From the transfer device 35, the collated products of type 2 can be fed to envisaged post or further processing. It is therefore possible to produce different collection types simultaneously and to feed them to different post processing processes. The repair function for incomplete collections, is available to both collection types in this collating method. Incomplete production collections are not discharged in the respective transfer device but, kept clamped in the receiving unit, are fed back to the collating region 32, the clamps are opened and completed with the missing supplement from the appropriate feed device 32.1-32.5.

By using the invention, flexible solutions for different post processing processes of pre-products and/or printed products can be implemented with considerably reduced expenditure on apparatus and considerably reduced demand for space. As a result of the use of a collating apparatus having only one conveying track for various post processing processes, sources of faults and expenditure on maintenance are also reduced. The expenditure for in-house logistics may likewise be reduced markedly, since the pre-products to be processed all have to be conveyed to only one system.

I claim:

1. A collating apparatus (10, 30, 40, 50, 60, '70, 80, 90) comprising:

a conveying track (11, 12, 22, 23, 39, 44) on which, in a closed circuit, a multiplicity of receiving units (13) arranged one after another in the direction of circulation to hold pre-products (P) to be collated circulate, and on which, in at least one collating region (32, 42, 43, 45, 46, 47, 83, 94, 95, 96) a plurality of feed devices (29, 32.1-32.5, 33) are arranged one after another in the direction of circulation, from which pre-products (P) are discharged into the receiving units (13) moving past on the conveying track (11, 12, 22, 23, 39, 44), the conveying track comprising an upper track portion (11) and a lower track portion (12) which are connected to each other at the ends by deflection regions (22, 23) and form a closed circuit, wherein at least one collating region (32) is provided on the upper track portion (11);

a three-dimensionally flexible conveying element (18) conveying the receiving units (13) on the conveying track (11, 12, 22, 23, 39, 44);

a clamping means (14, 15, 16) positioned with respect to each of the receiving units (13) and configured to hold the pre-products (P) collated in the receiving units (13) in a clamped manner; and transfer devices (34, 35, 37, 38, 48, 49, 51, 81, 82, 94, 95, 96) arranged at at least two points of the conveying track (11, 12, 22, 23, 39, 44) on the lower track portion (12) and/or in the deflection regions (22, 23) to receive the pre-products (P) off the receiving units (13) and to transport collated pre-products (P) away from the receiving units (13) for post processing; and a control system (36) that, in a predetermined way, controls the feed devices (29, 32.1-32.5, 33) to prepare more than one different collections of products (P) and controls the transfer devices (34, 35, 37, 38, 48, 49, 51, 81, 82, 91, 92,93) such that in each case the desired different collections of products (P) are transported to corresponding different ones of the transfer devices (34, 35, 37, 38, 48, 49, 51, 81, 82, 91, 92, 93).

2. The collating apparatus according to claim 1, wherein the transfer devices (34, 35, 37, 38, 48, 49, 51, 81, 82, 94, 95, 96) are controlled so that the pre-products (P) held in the receiving units (13) in a clamped manner can be conveyed through them and remain in the collating apparatus or are transported away for post processing.

3. The collating apparatus according to claim 1, wherein the upper track portion (11) and the lower track portion (12) run substantially in parallel.

4. The collating apparatus according to claim 1, wherein the upper track portion and the lower track portion in each case comprise a plurality of straight track portions (24, 26), the orientation of which is different and which are connected to one another by at least one curved section (25).

5. The collating apparatus according to claim 1, wherein a plurality of collating regions (42, 43, 45, 46, 47, 83, 94, 95, 96) are arranged one after another on the conveying track (39, 44) in the direction of circulation.

6. The collating apparatus according to claim 5, wherein at least one transfer device (38, 51, 48, 49, 81, 82, 91, 92, 93) is provided between successive collating regions (42, 43,45, 46, 47, 83, 94, 95, 96).

7. The collating apparatus according to claim 6, wherein the conveying track (39) is led out between the successive collating regions (42, 43, 45, 46, 94, 95, 96), forming at least one intermediate loop (41), and in that the associated transfer device (38, 51, 91, 92, 93) is arranged on the at least one intermediate loop (41).

8. The collating apparatus according to claim 1, wherein a plurality of transfer devices (34, 35, 92, 91) are arranged immediately one after another on the conveying track (11, 12, 22, 23, 39) in the direction of circulation.

9. The collating apparatus according to claim 1, wherein the conveying track (44) runs predominantly in a horizontal plane.

10. The collating apparatus according to claim 1, wherein the conveying track is rotated about its longitudinal axis in a preferably linear section, so that the receiving units (13), as they pass through this section (97), are preferably conveyed linearly and simultaneously pivoted radially.

11. The collating apparatus according to claim 1, wherein, by means of the control system (36), the products from a specific feed device (29, 32.1-32.5, 33) or a group of feed devices can be allocated to a specific transfer device (34, 35, 37, 38, 48, 49, 51, 81, 82, 91, 92, 93) and, by means of the latter, can be fed to specific post processing.

12. The collating apparatus according to claim 1, further comprising a product tracking system.

13. A method for collating and forwarding flat printed products using an apparatus according to claim 1, in particular pre-products (P), comprising the following steps:

a) collating a first collection (K1) of pre-products from a specific feed device (29, 32.1-32.5, 33) or a group of feed devices in a first receiving unit;

b) collating a further collection (K2) of pre-products, that is different from the first collection, from a second specific feed device (29, 32.1-32.5, 33) or a second group of feed devices in a following receiving unit; and c) feeding the first collection (K1) respectively to a first specific transfer device and therefore to specific post processing and the further collection (K2) of pre-products respectively to a second transfer device and therefore to other specific processing, wherein the transfer devices are arranged on the lower track portion (12) and/or the deflection regions (22, 23).

14. The method according to claim 13, further comprising: alternately collating different product collections (K1, K2) in receiving units (13) following one another directly, or collating the first product collection (K1) in groups of receiving units (13) following one another directly and in each case a further product collection (K2) is collated in following groups of receiving units (13).

15. The method according to claim 14, further comprising: discharging different product collections (K1, K2) from the respective receiving units simultaneously in different transfer devices (34, 35, 37, 38, 48, 49, 51, 81, 82, 91, 92, 93).

16. The method according to claim 13, wherein product collections (K, K1, K2) in different transfer devices (34, 35, 37, 38, 48, 49, 51, 81, 82, 91, 92, 93) are fed to post processing in each case separately or in an overlapping stream.

17. The method according to claim 13, further comprising: separately feeding a product collection (K) to post processing by means of sequential discharge in at least two transfer devices (34, 35, 37, 38, 48, 49, 51, 81, 82, 91, 92, 93).

18. The method according to claim 13, further comprising: generating gaps specifically in each case in the product collections (K, K1, K2) fed to post processing separately or in an overlapping stream from the different transfer devices (34, 35, 37, 38, 48, 49, 51, 81, 82, 91, 92, 93).

19. A collating apparatus (10, 30, 40, 50, 60, '70, 80, 90) comprising:

a closed conveying track (11, 12, 22, 23, 39, 44) on which, in a closed circuit, a multiplicity of receiving units (13) arranged one after another in the direction of circulation to hold pre-products (P) to be collated circulate, and on which, in at least one collating region (32, 42, 43, 45, 46, 47, 83, 94, 95, 96) a plurality of feed devices (29, 32.1-32.5, 33) are arranged one after another in the direction of circulation, from which pre-products (P) are discharged into the receiving units (13) moving past on the conveying track (11, 12, 22, 23, 39, 44), the closed conveying track comprising an upper track portion (11) and a lower track portion (12), wherein the upper track portion (11) and the lower track portion (12) run substantially in parallel, which are connected to each other at the ends by deflection regions (22, 23) and form a closed circuit, wherein at least one collating region (32) is provided on the upper track portion (11);

a three-dimensionally flexible conveying element (18) conveying the receiving units (13) on the conveying track (11, 12, 22, 23, 39, 44), wherein the conveying element (18) includes a plurality of running rollers (19) connected to one another in a closed chain circuit by connecting pieces (20), wherein the running rollers (19) run in corresponding guide rails (21) of the closed conveying track (11, 12, 22, 23, 39, 44);

a clamping means (14, 15, 16) positioned with respect to each of the receiving units (13) and configured to hold the pre-products (P) collated in the receiving units (13) in a clamped manner;

a first transfer device (34, 35, 37, 38, 48, 49, 51, 81, 82, 94, 95, 96) arranged at a first point of the closed conveying track (11, 12, 22, 23, 39, 44) on the lower track portion (12) and/or in the deflection regions (22, 23) to receive the pre-products (P) off the receiving units (13) and to transport a first combination of collated pre-products (P) away from the receiving units (13) for post processing;

a second transfer device (34, 35, 37, 38, 48, 49, 51, 81, 82, 94, 95, 96) arranged at a different second point of the closed conveying track (11, 12, 22, 23, 39, 44) on the lower track portion (12) and/or in the deflection regions (22, 23) to receive the pre-products (P) off the receiving units (13) and to transport a different second combination of collated pre-products (P) away from the receiving units (13) for post processing; and a control system (36) that controls the feed devices (29, 32.1-32.5, 33) and the transfer devices (34, 35, 37, 38, 48, 49, 51, 81, 82, 91, 92,93) such that the control system alternates the feed devices between depositing the first and second combinations of collated printing pre-products (P) with the receiving units (13) and alternatingly controls the corresponding first or second transfer device to feed the first and second combinations of collated printing pre-products (P) to corresponding post processing.

20. The collating apparatus according to claim 1, wherein each of the receiving units (13) is fixed to a conveying element (18) including a plurality of running rollers (19) connected to one another in a closed chain circuit by connecting pieces (20), wherein the running rollers (19) run in corresponding guide rails (21) of the conveying track (11, 12, 22, 23, 39, 44).

* * * * *